US008882547B2

(12) United States Patent
Asakuma et al.

(10) Patent No.: US 8,882,547 B2
(45) Date of Patent: Nov. 11, 2014

(54) SCREW TERMINAL BLOCK AND ATTACHMENT PLUG INCLUDING THE SAME

(75) Inventors: Yoshiaki Asakuma, Mie (JP); Takashi Kawamoto, Mie (JP); Toshiyuki Takii, Mie (JP)

(73) Assignee: Panasonic Corporation, Osaka (JP)

( * ) Notice: Subject to any disclaimer, the term of this patent is extended or adjusted under 35 U.S.C. 154(b) by 236 days.

(21) Appl. No.: 13/543,048

(22) Filed: Jul. 6, 2012

(65) Prior Publication Data

US 2013/0017738 A1 Jan. 17, 2013

(30) Foreign Application Priority Data

Jul. 11, 2011 (JP) ..... 2011-153122

(51) Int. Cl.
*H01R 4/36* (2006.01)
*H01R 4/42* (2006.01)

(52) U.S. Cl.
CPC ..... *H01R 4/42* (2013.01)
USPC ..... 439/810

(58) Field of Classification Search
USPC ..... 439/692–695, 801–814, 860, 883
See application file for complete search history.

(56) References Cited

U.S. PATENT DOCUMENTS 2,958,068 A * 10/1960 Lipinski ..... 439/752
3,605,059 A * 9/1971 Lipinski et al. ..... 439/106
3,823,381 A * 7/1974 Maloof ..... 439/695
4,219,251 A * 8/1980 Romine ..... 439/692
4,466,686 A * 8/1984 Houser ..... 439/568

FOREIGN PATENT DOCUMENTS

| | | |
|---|---|---|
| EP | 1596471 | 11/2005 |
| JP | 3-26976 | 3/1991 |
| TW | M317665 | 8/2007 |
| TW | I286402 | 9/2007 |
| TW | I325667 | 6/2010 |

OTHER PUBLICATIONS

Taiwan Office action, dated Jun. 24, 2014 along with an english translation thereof.

* cited by examiner

*Primary Examiner* — Khiem Nguyen
(74) *Attorney, Agent, or Firm* — Greenblum & Bernstein, P.L.C.

(57) ABSTRACT

A screw terminal block 10A includes a terminal plate 12 provided with an insertion hole 12*a* through which a terminal screw 11 is inserted; and a fastening plate 13 provided with a screw hole 13*a* to which the terminal screw 11 inserted through the insertion hole 12*a* is screwed. The screw hole 13*a* is formed in the fastening plate 13, and a protrusion 13*b* is provided at right and left sides of the fastening plate 13. Upper and lower locking pieces 12*b* protruding toward the fastening plate 13 are provided at right and left side ends of the terminal plate 12 to sandwich the protrusion 13*b* therebetween. The locking piece 12*b* of the terminal plate 12 and the protrusion 13*b* of the fastening plate 13 are engaged with each other to restrict the relative rotation of the fastening plate 13 and the terminal plate 12.

8 Claims, 12 Drawing Sheets

SCREW TERMINAL BLOCK AND ATTACHMENT PLUG INCLUDING THE SAME

FIELD OF THE INVENTION

The present invention relates to a screw terminal block and an attachment plug including the same.

Conventionally, there is provided a screw terminal block, e.g., disclosed in Japanese Unexamined Utility Model Application Publication No. H03-26976, in which a screw terminal is disposed on a terminal base, the screw terminal being configured by screwing a terminal screw into a screw hole provided in a terminal plate. In this screw terminal block, a washer is interposed between a seating face of the terminal screw and the terminal plate. The washer comes into contact with a wall provided in the terminal base made of a resin, which makes it difficult to rotate the washer in conjunction with the terminal screw.

In the screw terminal block disclosed in the above cited reference, a gap is provided between the wall disposed in the terminal base and the washer so as to allow the washer to move up and down as the terminal screw rotates, thereby enabling the washer to rotate by an amount of the gap. Accordingly, if the washer collides with the wall due to impact shocks such as a fall, the washer is likely to rotate in a direction of loosening the terminal screw, so that the terminal screw may be loosened.

SUMMARY OF THE INVENTION

In view of the above, an object of the present invention is to provide a screw terminal block capable of preventing a terminal screw from loosening, and an attachment plug using the same.

According to an aspect of the present invention, there is provided a screw terminal block including:

a terminal screw;

a terminal plate provided with an insertion hole through which the terminal screw is to be inserted;

a fastening plate provided with a screw hole to which the terminal screw inserted through the insertion hole is to be screwed;

a rotation restricting part for restricting the rotation of the fastening plate.

In the screw terminal block, it is preferred that a plug pin to be plug-in connected to a receptacle is provided integrally with the terminal plate.

In the screw terminal block, the rotation restricting part preferably includes: a protrusion provided on at least one side of the fastening plate; and a pair of locking pieces provided on at least one side of the terminal plate so as to sandwich the protrusion therebetween.

In the screw terminal block, it is preferred that dimensions of the rotation restricting part and the fastening plate are designed such that the protrusion of the fastening plate is not protruded outward beyond the locking piece of the terminal plate.

According to another aspect of the present invention, there is provided an attachment plug including the screw terminal block described above, a plug body, a plug pin, and an electric cord. The plug body accommodates the above screw terminal block. The plug pin is electrically connected to the terminal plate, and protrudes outward from the plug body to be plug-in connected to the receptacle. The electric cord is connected to the screw terminal block and extended outward from the plug body.

In accordance with the present invention, there are provided a screw terminal block capable of preventing the terminal screw from loosening, and an attachment plug including the same.

BRIEF DESCRIPTION OF THE DRAWINGS

The objects and features of the present invention will become apparent from the following description of embodiments, given in conjunction with the accompanying drawings, in which:

FIGS. 1A to 1C show a screw terminal block in accordance with a first embodiment of the present invention, wherein FIG. 1A is an exploded perspective view, FIG. 1B is an external perspective view when viewed from the front side, and FIG. 1C is an external perspective view when viewed from the rear side;

FIGS. 3A and 3B show the screw terminal block in FIGS. 1A to 1C, wherein FIG. 3A is an enlarged view of the main part, when viewed from the front side, showing the state where the terminal screw is fastened, and FIG. 3B is an enlarged view of the main part, when viewed from the rear side, showing the state where the terminal screw is fastened;

FIGS. 5A to 5C show a modification of the screw terminal block, wherein FIG. 5A is an external perspective view, FIG. 5B is a rear view, and FIG. 5C is an external perspective view of a terminal plate;

FIGS. 6A to 6C show an attachment plug in accordance with a second embodiment of the present invention, wherein FIG. 6A is a front view, FIG. 6B is a top view, and FIG. 6C is a right side view;

FIGS. 10A and 10B show the attachment plug in FIGS. 6A to 6C, wherein FIG. 10A is a perspective view of a body block when viewed from the rear side, and FIG. 10B is a perspective view of a body when viewed from the rear side; and FIGS. 11A to 11C show the attachment plug in FIGS. 6A to 6C, wherein FIG. 11A is a plan view of the body block when viewed from the rear side, and FIGS. 11B to 11D are side views partially abbreviated for explaining the states of the screw terminal block when a multi-core cable is pulled backwardly.

Figure 1A:
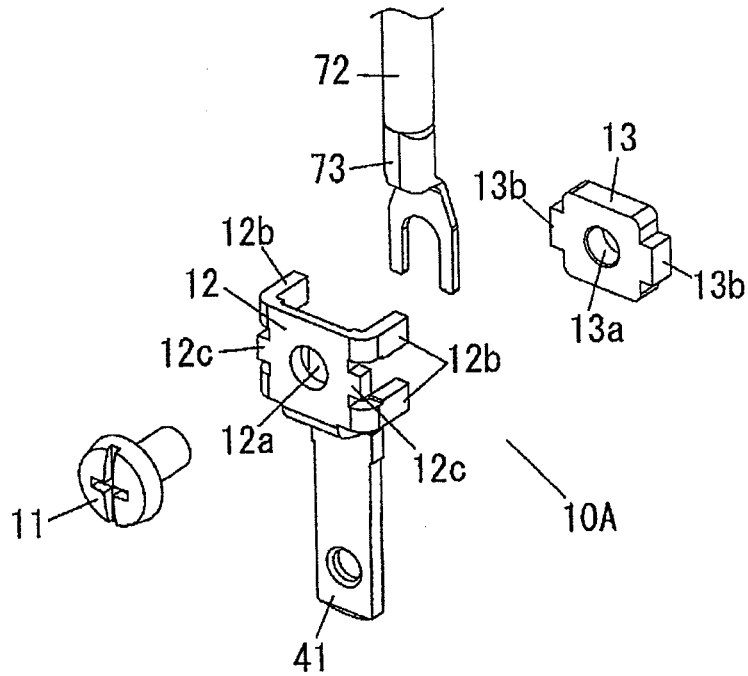
Figure 1B:
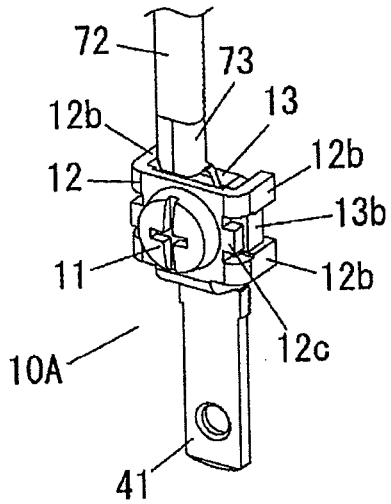
Figure 1C:
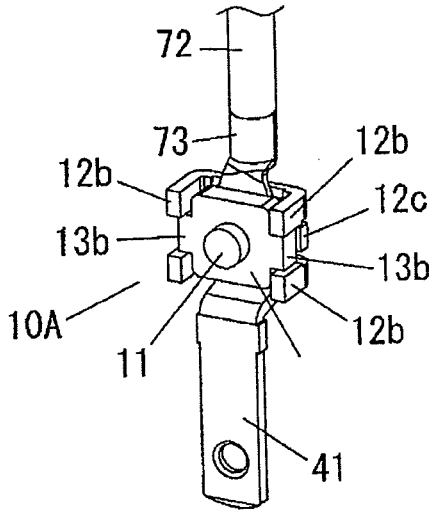
Figure 2A:
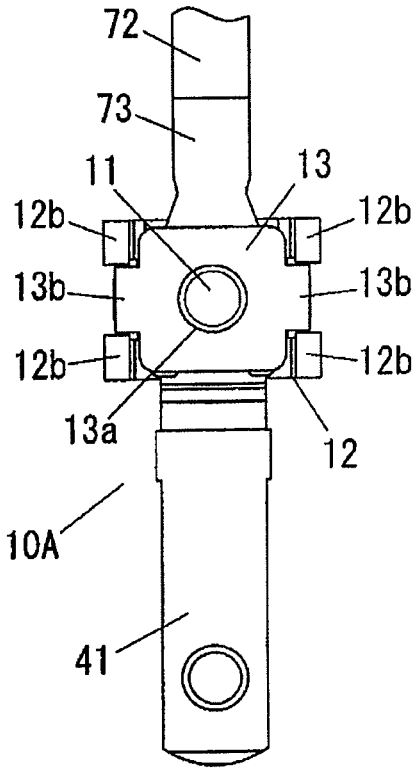
FIG. 2A is a rear view of the screw terminal block in FIGS. 1A to 1C.
Figure 2B:
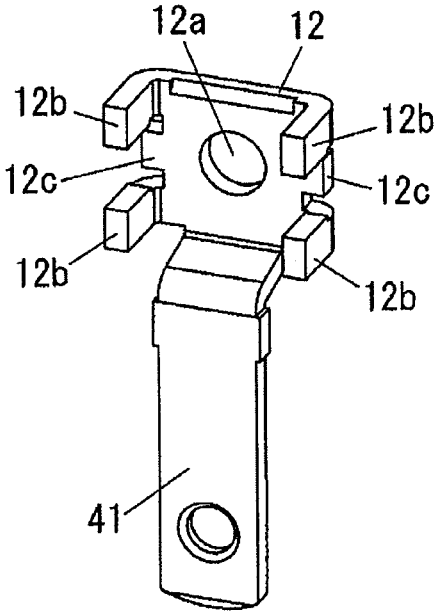
FIG. 2B is an external perspective view of a terminal plate.

DETAILED DESCRIPTION OF THE EMBODIMENT (First Embodiment)

A screw terminal block in accordance with a first embodiment of the present invention will be described in detail with reference to FIGS. 1A to 5C. Note that, in the description of the screw terminal block, unless otherwise noted, up-down and right-left directions are defined based on the directions shown in FIG. 2A, and a front-rear direction is defined as a direction perpendicular to the sheet in FIG. 2A, but directions in which the screw terminal block 10A is actually used are not limited to the above directions.

The screw terminal block 10A includes: a terminal plate 12 provided with an insertion hole 12*a* through which a terminal screw 11 is to be inserted; and a fastening plate 13 provided with a screw hole 13*a* to which the terminal screw 11 inserted through the insertion hole is to be screwed.

The fastening plate 13 is formed into a substantially rectangular shape, when viewed from the front, by pressing a metal plate. Protrusions 13*b* are provided in central portions of both right and left sides of the fastening plate 13, respectively.

The terminal plate 12 is also formed into a substantially rectangular shape, when viewed from the front, by pressing a highly conductive metal plate. A plug pin 41 extending downward from a lower edge of the terminal plate 12 is provided integrally with the terminal plate 12. On right and left sides of the terminal plate 12, there are provided locking pieces 12*b* (rotation restricting part) protruding toward the fastening plate 13 from upper and lower portions of the terminal plate 12 so as to interpose the protrusion 13*b* between the upper and lower locking pieces 12*b*. Further, on the right and left sides of the terminal plate 12, there are provided protrusions 12*c* extending outward in the right and left directions respectively from an intermediate portion between the upper and lower locking pieces 12*b*, 12*b*. The protrusion 12*c* protrudes in the right-left direction beyond the protrusion 13*b*, that is, the protrusion 13*b* is located inside the protrusion 12*c* in the right-left direction. Herein, the rotation restricting part is constituted by the locking piece 12*b* of the terminal plate 12 and the protrusion 13*b* of the fastening plate 13. Note that, although the plug pin 41 is provided integrally with the terminal plate 12 in the present embodiment, the plug pin 41 and the terminal plate 12 may be formed separately and joined together by, e.g., caulking or welding.

The terminal screw 11 is inserted through the insertion hole 12*a* of the terminal plate 12 and screwed into the screw hole 13*a* of the fastening plate 13. When the terminal screw 11 is made to rotate in a fastening direction (indicated by the arrow D1 shown in FIG. 3A), the fastening plate 13 is rotated in conjunction with the terminal screw 11 in the direction indicated by the arrow D2 shown in FIG. 3B. At this time, the left-hand side protrusion 13*b* in FIG. 3B comes into contact with the lower left locking piece 12*b* and the right-hand side protrusion 13*b* comes into contact with the upper right locking piece 12*b*. This restricts the rotation of the fastening plate 13. When the terminal screw 11 is further rotated in the fastening direction from this state, the terminal screw 11 comes into screw engagement with the screw hole 13*a* because the rotation of the fastening plate 13 is restricted. When the torque of fastening the terminal screw 11 reaches a predetermined value, an operator stops screwing the terminal screw 11. Thus, when a conductive part of an electric cord 72 or a substantially U-shape crimped terminal 73 swaged to the conductive part is interposed between the terminal plate 12 and the fastening plate 13, the terminal plate 12 and the fastening plate 13 clamp the conductive part or the crimped terminal 73 therebetween, so that the conductive part or the crimped terminal 73 is connected to the screw terminal block 10A. FIG. 4A shows the state where the U-shape crimped terminal 73 is fastened between the terminal plate 12 and the fastening plate 13. Further, FIG. 4B shows the state where a twisted wire 72*a* serving as the conductive part of the electric cord 72 is connected between the terminal plate 12 and the fastening plate 13. In cases where the twisted wire 72*a* is connected, the twisted wire 72*a* is connected to one side of the terminal plate 12 in between the terminal plate 12 and the fastening plate 13. Note that, when the terminal screw 11 is rotated in a direction of loosening the terminal screw 11 (counterclockwise in FIG. 3A), the fastening plate 13 rotates in conjunction with the terminal screw 11. When the fastening plate 13 rotates according to the rotation of the terminal screw 11, the left-hand side protrusion 13*b* of the fastening plate 13 shown in FIG. 3B comes into contact with the upper left locking piece 12*b* and the right-hand side protrusion 13*b* comes into contact with the lower right locking piece 12*b*, thereby restricting the rotation of the fastening plate 13. When further rotated in the loosening direction from this state, the terminal screw 11 remains rotated in the loosening direction relative to the fastening plate 13 because the fastening plate 13 is restricted to rotate. This releases the state where the conductive part or the crimped terminal 73 is connected in between the terminal plate 12 and the fastening plate 13.

Figure 3A:
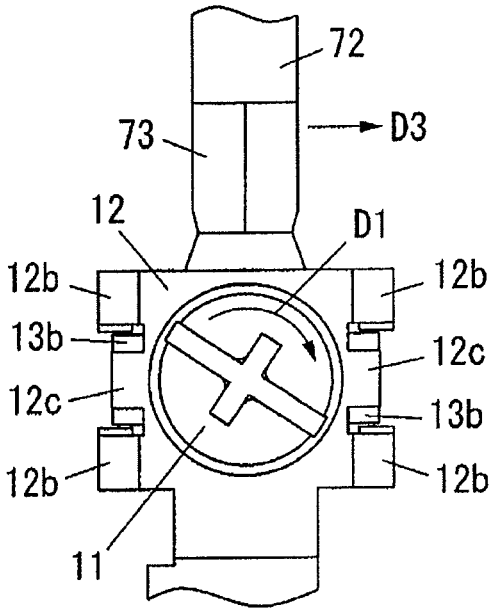
Figure 3B:
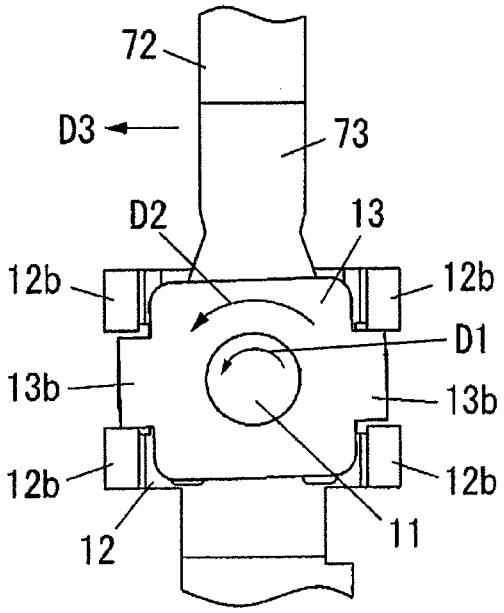
Figure 4A:
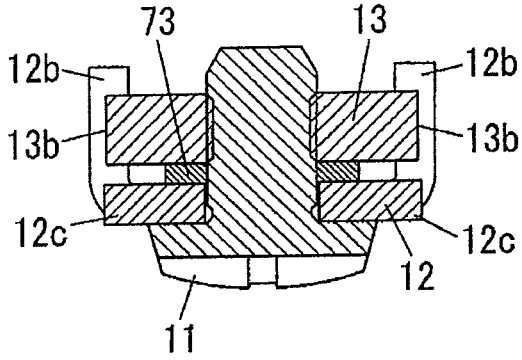
FIG. 4A is a cross sectional view showing the state where a crimp-type terminal is connected to the screw terminal block in FIGS. 1A to 1C.
Figure 4B:
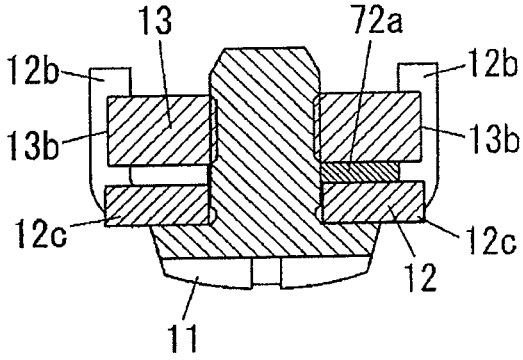
FIG. 4B is a cross sectional view showing the state where a twisted wire is connected to the screw terminal block in FIGS. 1A to 1C.

By the way, in the state where the terminal plate 12 and the fastening plate 13 are fixed by using the terminal screw 11, the protrusion 13*b* comes into contact with the locking piece 12*b* as shown in FIG. 3B. This restricts the rotation of the fastening plate 13 such that the fastening plate 13 fails to rotate in the direction of the arrow D2. Accordingly, in the state where the electric cord 72 is in connection with the screw terminal block 10A, even if the electric cord 72 is pulled in a direction of loosening the terminal screw 11 (indicated by the arrow D3 shown in FIGS. 3A and 3B) and torque of rotating the crimped terminal 73 is applied, the fastening plate 13 will not rotate in the direction of the arrow D2 in conjunction with the crimped terminal 73. This makes it difficult for the fastening plate 13 to rotate in the direction of loosening the terminal screw 11 in conjunction with the crimped terminal 73, thereby suppressing the terminal screw 11 to be loosened.

The screw terminal block 10A, as described above, includes the terminal plate 12 provided with the insertion hole 12*a* through which the terminal screw 11 is inserted; and the fastening plate 13 provided with the screw hole 13*a* to which the terminal screw 11 passing through the insertion hole 12*a* is screwed. Further, in the terminal plate 12, there is provided the rotation restricting part for restricting the rotation of the fastening plate 13.

Thus, the terminal plate 12 and the fastening plate 13 are fastened by using the terminal screw 11, so that the rotation restricting part restricts the terminal plate 12 and the fastening plate 13 to rotate relatively in the state where the conductive part is interposed between the terminal plate 12 and the fastening plate 13. Thus, even if torque of loosening the terminal screw 11 is applied to the electric cord 72 connected to the screw terminal block 10A, the fastening plate 13 is hardly rotated in the direction of loosening the terminal screw 11, so that the screw terminal block 10A can suppress the looseness of the terminal screw 11.

Further, in the present embodiment, the plug pin 41 is provided integrally with the terminal plate 12.

In a case where the screw terminal block 10A is employed in the attachment plug, since the plug pin 41 is provided integrally with the terminal plate 12, the number of components can be reduced. Further, even if an impact shock due to a fall or the like is applied to the attachment plug, the terminal screw of the attachment plug is suppressed from being loosened.

Furthermore, in the present embodiment, the rotation restricting parts are provided on both sides of the insertion hole 12*a* of the terminal plate 12.

Accordingly, even if the torque of loosening the terminal screw 11 is applied to the electric cord 72 connected to the screw terminal block 10A, the both-side rotation restricting parts can receive the torque of loosening the terminal screw 11, whereby the terminal screw 11 may not be loosened as compared with the case where the rotation restricting part is provided on only one side of the insertion hole 12*a*.

Furthermore, in the present embodiment, dimensions of the rotation restricting part and the fastening plate 13 are designed such that a portion (the protrusion 13*b* in the present embodiment) of the fastening plate 13 restricted by the rotation restricting part (the locking piece 12*b* of the terminal plate 12) is not protruded outward beyond the rotation restricting part.

Since the fastening plate 13 is not protruded outward beyond the rotation restricting part, the torque of loosening the terminal screw 11 is difficult to be applied to the fastening plate 13, so that the terminal screw 11 is hardly loosened. Note that, in the present embodiment, the protrusion 12*c* is provided in the terminal plate 12 to overlap the portion (the protrusion 13*b* in the present embodiment) of the fastening plate 13 restricted by the rotation restricting part in the front-rear direction. The protrusion 12*c* extends outward beyond the protrusion 13*b*.

In this way, since the protrusion 13*b* of the fastening plate 13 is located inside the protrusion 12*c*, i.e., the protrusion 13*b* is not protruded outward beyond the protrusion 12*c*, the torque of loosening the terminal screw 11 is hardly applied to the protrusion 13*b* of the fastening plate 13, so that the terminal screw 11 is hard to be loosened.

Figure 5A:
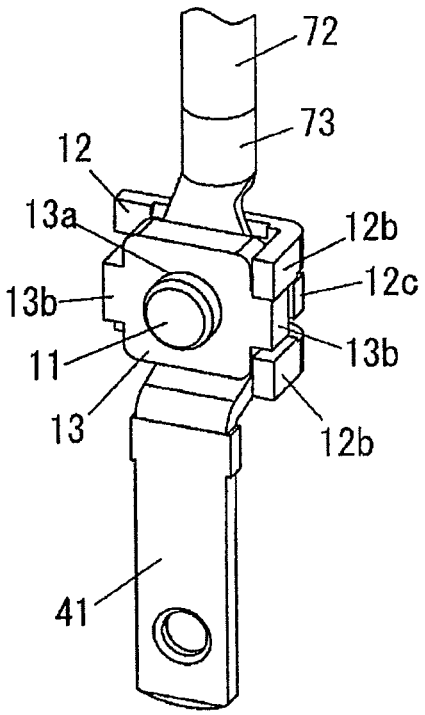
Figure 5B:
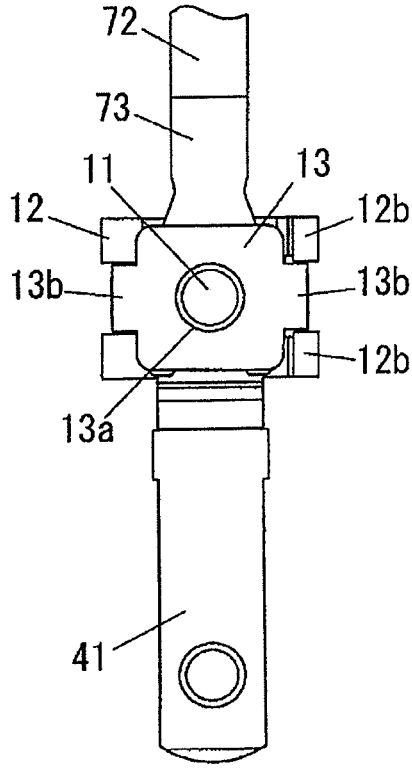
Figure 5C:
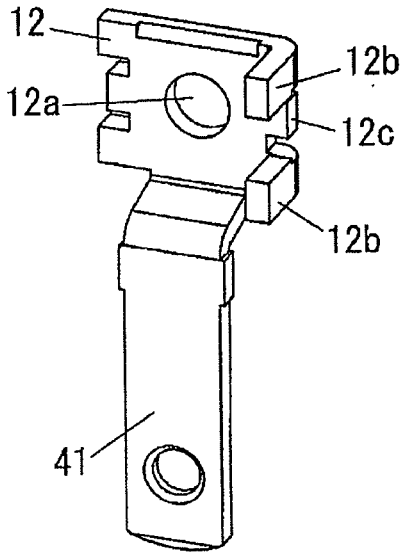

Note that the locking pieces 12*b*, as the rotation restricting part, are provided on the both sides of the insertion hole 12*a* in the present embodiment, but the locking piece 12*b* may be provided on only one side of the insertion hole 12*a* as shown in FIGS. 5A to 5C.

(Second Embodiment)

Figure 6A:
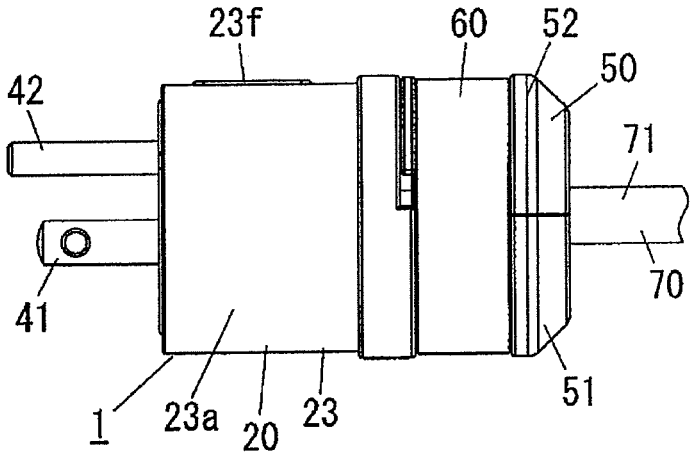
Figure 6B:
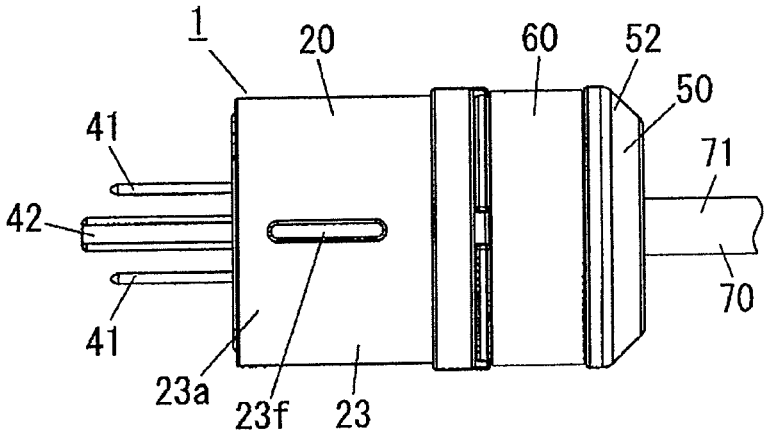
Figure 6C:
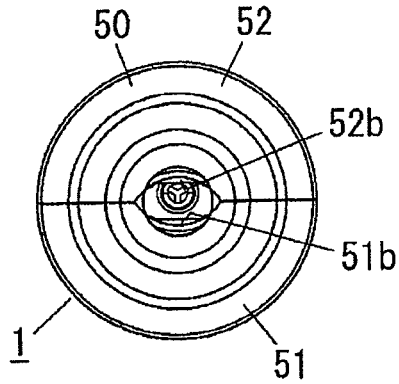

An attachment plug in accordance with a second embodiment of the present invention will be described in detail with reference to FIGS. 6A to 11D. The attachment plug of the present embodiment, for example, used in a charging cable of an electric vehicle (including a hybrid electric vehicle and a plug-in hybrid electric vehicle), is connected to a receptacle of a charging station installed in a store, a business facility or the like, or a wall socket of a house. Note that, in the following description of the attachment plug, unless otherwise noted, a vertical direction in FIG. 6A is defined as an up-down direction, a horizontal direction in FIG. 6A is defined as a front-rear direction, and a vertical direction in FIG. 6B is defined as a right-left direction, but directions in which the attachment plug 1 is in use are not limited to the above directions.

The attachment plug 1 mainly includes a plug body 20, a triple of screw terminal blocks 10A, 10A and 10B, an electric wire positioning member 30, two power plug pins 41 (W-pole and L-pole), a ground plug pin 42, an electric wire clamping part 50, and an elastic band 60.

The screw terminal blocks 10A, 10A and 10B are accommodated within the plug body 20 as shown in FIGS. 8 to 10B. The power plug pins 41 are provided in the screw terminal blocks 10A and 10A, respectively. The ground plug pin 42 is provided in the screw terminal block 10B. The screw terminal block 10A has the same configuration as that of the first embodiment, so the redundant description thereof will be omitted. The screw terminal block 10B differs from the screw terminal block 10A in that it includes a substantially U-shape plug pin 42 instead of the plug pin 41. The other configuration is identical to that of the screw terminal block 10A, so the same reference numerals are assigned to the same components which are common in the first embodiment, and the redundant description thereof will be omitted. Note that the plug pins 41 and 42 are electrically connected to the respective terminal plates 12 of the corresponding screw terminal blocks 10A and 10B; protrude forward from a front surface of the plug body 20; and are adapted to be plug-in connected to a plug receiver (not shown) such as a receptacle or an extension socket. Further, electric cords 72 of a multi-core cable 70, configured by grouping a plurality of twisted wires, are connected to the screw terminal blocks 10A, 10A and 10B respectively, and the multi-core cable 70 is extended outward from a rear end of the plug body 20.

As shown in FIGS. 6A to 9, the plug body 20 is configured by assembling a body block 26 and a shell 23 made of synthetic resin, the body block 26 being constituted by a body 21 and a cover 22, which are made of synthetic resin.

Figure 8:
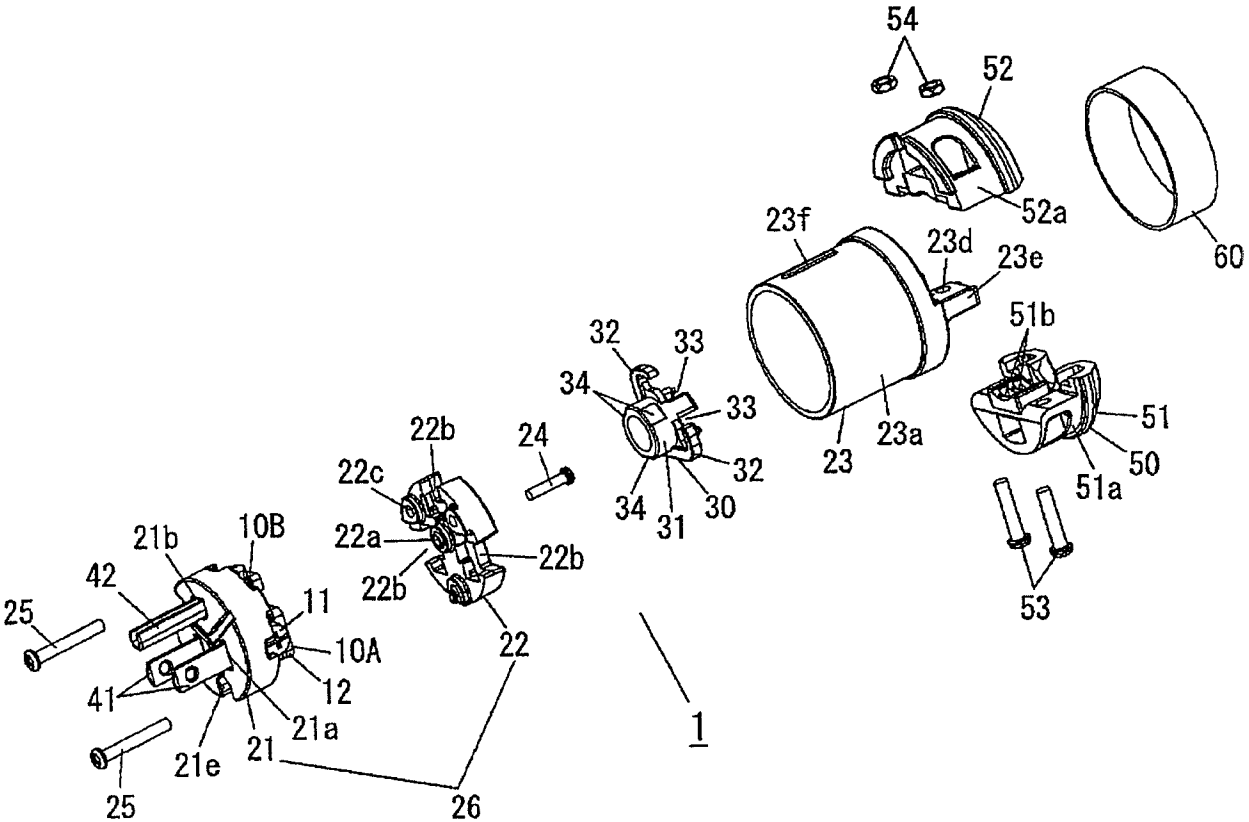
FIG. 8 is an exploded perspective view of the attachment plug in FIG. 6 when viewed from the front side.
Figure 9:
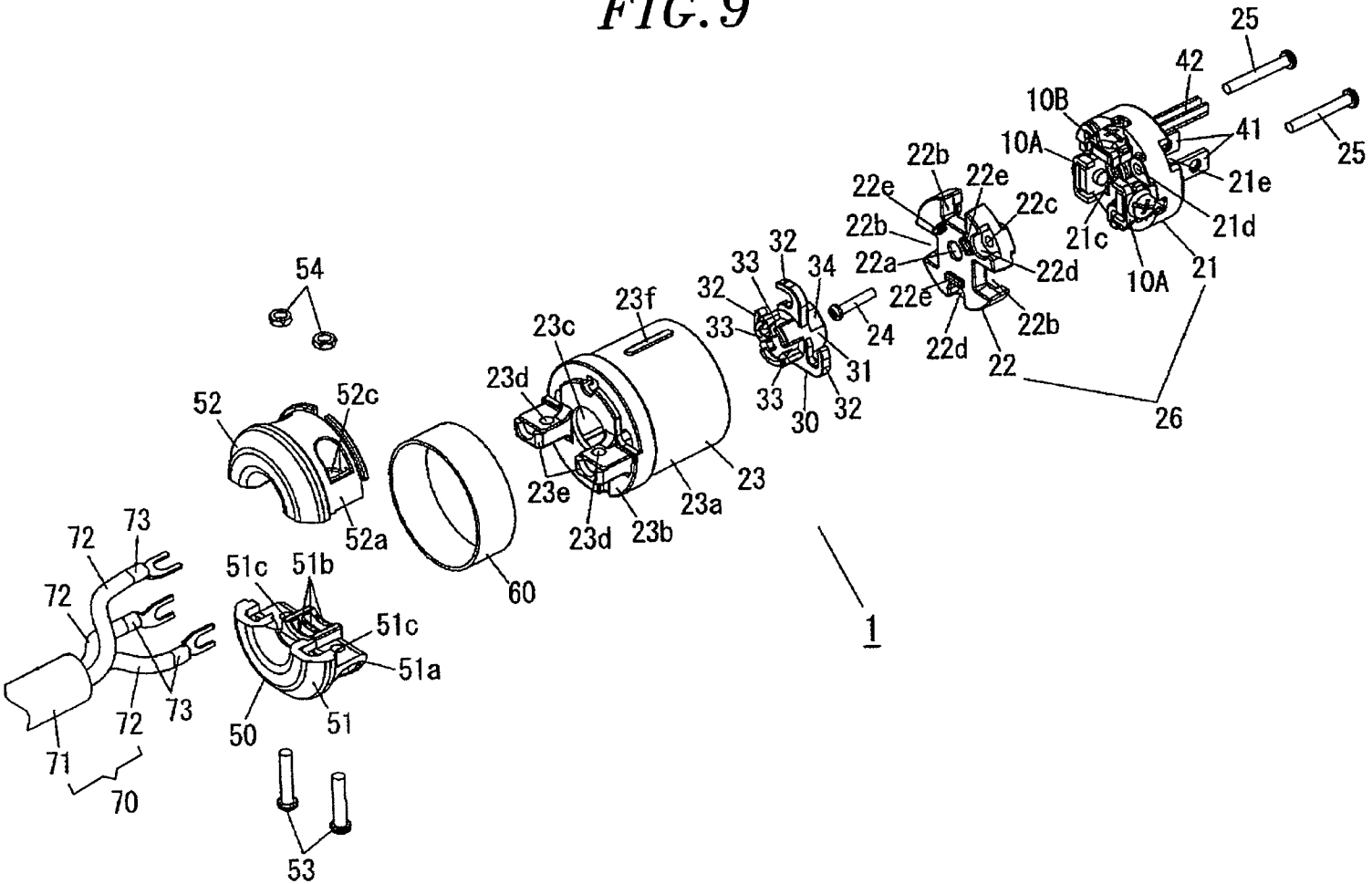
FIG. 9 is an exploded perspective view of the attachment plug shown in FIG. 6 when viewed from the rear side.

As shown in FIGS. 8 and 9, the shell 23 integrally includes: a cylinder part 23*a* in which the body block 26 (including the body 21 and the cover 22) is accommodated; and a back wall 23*b* disposed on a rear end of the cylinder part 23*a*. In a center portion of the back wall 23*b*, there is provided a circular hole 23*c* for passing the multi-core cable 70 connected to the screw terminal blocks 10A, 10A and 10B therethrough. On a rear surface of the back wall 23*b*, boss sections 23*e* with an insertion hole 23*d* are provided on left and right sides of the circular hole 23*c*, respectively. Further, on an outer periphery of the cylinder part 23*a*, a protrusion 23*f* for indicating a position of the ground plug pin 42 is provided so as to correspond to the ground plug pin 42.

The body 21, having a substantially disc shape as shown in FIGS. 7 to 10B, is attached to the shell 23 so as to close an opening provided in a front side of the shell 23. In the body 21, there are provided: two insertion holes 21*a* through which the power plug pins 41 with a flat shape (hereinafter, referred to as "plug blade") are inserted respectively; and an insertion hole 21*b* through which the ground plug pin 42 with the substantially U-shape (hereinafter, referred to as "plug pin") is inserted, each of which passes through the body 21 in the front-rear direction. The power screw terminal blocks 10A, 10A and the ground screw terminal block 10B are held in the body 21 in the state where the plug blades 41, 41 and the plug pin 42 are inserted through the corresponding insertion holes 21*a*, 21*a*, and 21*b* respectively. In a center portion of a rear surface of the body 21, there is provided a screw hole 21*c* for fixing the cover 22 by using a screw. Further, in the body 21, there are provided two insertion holes 21*d* through which mounting screws 25 for fixing the body 21 to the shell 23 are inserted respectively, and the insertion hole 21*d* is formed through the body 21 in the front-rear direction. Furthermore, in a front surface of the body 21, a recess 21*e* for avoiding interference with a screw head of the mounting screw 25 is provided around an outer periphery of each insertion hole 21*d*.

The cover 22, having a substantially disc shape as shown in FIGS. 8 to 10B, is disposed on the rear surface side of the body 21. A mounting screw 24 inserted through a stepped hole 22*a* provided in a substantially center portion of the cover 22 is screwed into the screw hole 21*c* of the body 21 to fix the cover 22 on the body 21. In order to avoid interference with the screw terminal blocks 10A, 10A and 10B, recessed grooves 22*b* with a substantially U-shape are provided in the cover 22 so as to correspond to the screw terminal blocks 10A, 10A and 10B. Further, insertion holes 22*c* for passing a screw therethrough are provided in the cover 22 so as to correspond to the respective insertion holes 21*d* of the body 21. Around a peripheral portion of the insertion hole 22*c* in a rear surface of the cover 22, there are provided recesses 22*d* into which the boss sections provided in the shell 23 are inserted. Note that, in the state where the body 21 and the cover 22 are coupled with each other, the terminal plate 12 and the fastening plate 13 of each of the screw terminal blocks 10A, 10A and 10B are exposed from each recessed groove 22*b*. Therefore, a conductive wire or a crimped terminal can be inserted between the terminal plate 12 and the fastening plate 13 through the recessed groove 22*b*. Further, the terminal screws 11 of the respective screw terminal blocks 10A, 10A and 10B are exposed from the recesses disposed in the periphery of the body 21 and the cover 22. Therefore, the terminal screw 11 can be fastened or loosened by using such a tool as a screw driver.

As shown in FIGS. 8 and 9, a cylinder part 31 and three hooking pieces 32 extending outward from a circumferential surface of the cylinder part 31 are integrally provided to form the electric wire positioning member 30, which is molded of synthetic resin. The three hooking pieces 32, formed into a substantially L-shape, are provided so as to correspond to the three recessed grooves 22*b* of the cover 22 respectively. Further, in a peripheral surface of the cylinder part 31, there is provided a slit 33 extending from a root of each of the three hooking pieces 32 to a rear end portion of the cylinder part 31. Furthermore, in a front portion of the cylinder part 31, three flat portions 34 are formed on its circumferential surface. The flat portions 34 come into contact with corresponding three protrusions 22*e* provided on the rear surface of the cover 22, so that the cylinder part 31 is positioned in alignment with the cover 22.

Figure 7:
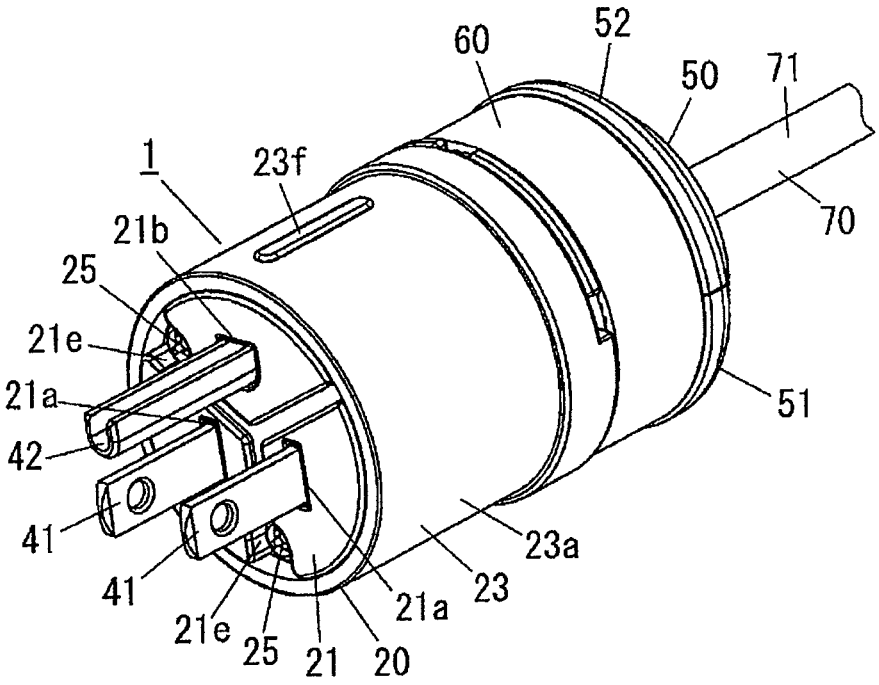
FIG. 7 is an external perspective view of the attachment plug in FIG. 6.

The wire clamping part 50 includes: supporting bodies 51 and 52 assembled to form a cylindrical shape for interposing the multi-core cable 70 therebetween; and two pairs of mounting screw 53 and nut 54 for coupling the supporting bodies 51 and 52, as shown in FIGS. 7 to 9. Each of the supporting bodies 51 and 52 has such a semi-cylindrical shape obtained by dividing a cylinder into two pieces by a plane containing its rotation axis. On outer peripheries of the supporting bodies 51 and 52, there are respectively provided recessed grooves 51*a* and 52*a* with which an elastic band 60 is engaged. On surfaces of the supporting bodies 51 and 52 to be coupled with each other, a plurality of protrusion pieces 51*b* and 52*b* is formed at intervals in the front-rear direction around a center of the cylinder formed by the supporting bodies 51 and 52. The protrusion pieces 51*b* and 52*b* serve to prevent the multi-core cable 70 from being affected by a tensile stress applied thereto by biting a sheath 71 of the multi-core cable 70.

The attachment plug 1, having the above configurations, is assembled as follows.

Figure 10A:
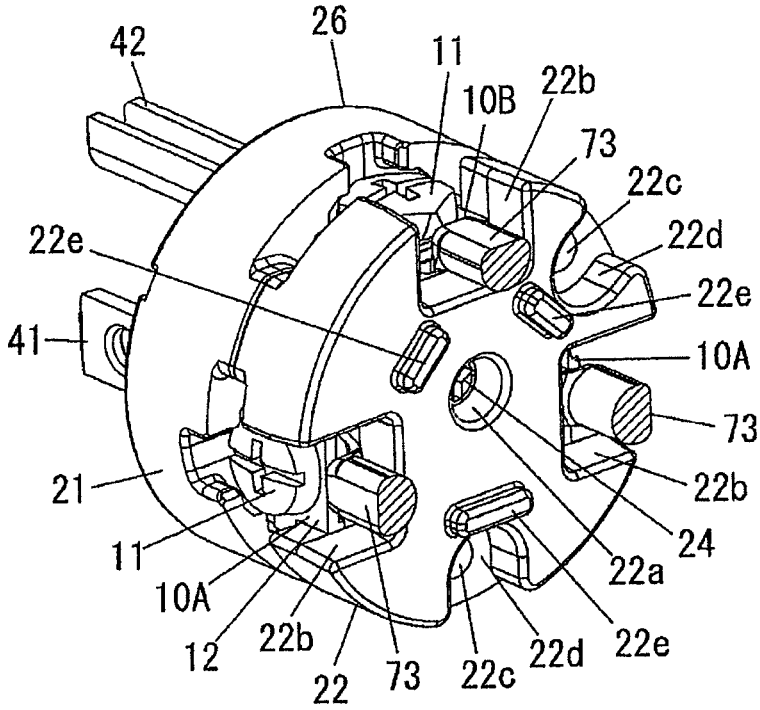
Figure 10B:
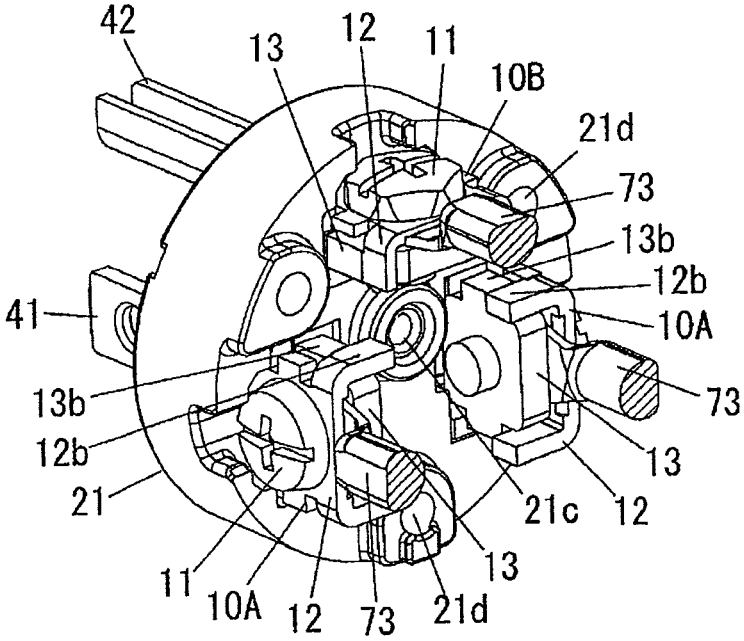

Firstly, an operator inserts the plug blades 41 and 41 into the insertion holes 21*a* and 21*a* of the body 21, and inserts the plug pin 42 into the insertion hole 21*b*, whereby the screw terminal blocks 10A, 10A and 10B are held in the body 21 (see FIG. 10B). Secondly, the operator superposes the cover 22 on the rear surface of the body 21 and screws the mounting screw 24, inserted through the stepped hole 22*a* of the cover 22, into the screw hole 21*c* of the body 21, whereby the cover 22 is fixed to the body 21 (see FIG. 10A). At this time, the screw terminal blocks 10A, 10A and 10B are interposed between the body 21 and the cover 22, and held by the body block 26.

Next, the operator inserts the multi-core cable 70 through the circular hole 23*c* of the shell 23, and swages the respective crimped terminals 73 onto a tip end of each electric cord 72 exposed by stripping its sheath 71. As shown in FIG. 9, the three electric cords 72 are bent at substantially a right angle around an outlet of the sheath 71 respectively. An intermediate portion of each electric cord 72 is further bent at substantially a right angle, so that the crimped terminals 73, swaged on the respective electric cords 72, are aligned so as to direct to the same direction. When the multi-core cable 70 is inserted from the above into the electric wire positioning member 30 with the slit 33 directed upward, three hooking pieces 32 of the electric wire positioning member 30 hold the corresponding electric cords 72 respectively. The three hooking pieces 32 are arranged to have the same interval at which the screw terminal blocks 10A, 10A and 10B are disposed. Thus, the electric cords 72 held by the hooking pieces 32 are aligned so as to correspond to the screw terminal blocks 10A, 10A and 10B, respectively. When the operator brings the electric wire positioning member 30 near the body block 26 in the state where the terminal screw 11 of each of the screw terminal blocks 10A, 10A and 10B is loosened, the crimped terminal 73 swaged on the electric cord 72 is inserted into between the corresponding terminal plate 12 and fastening plate 13. When the operator further pushes the multi-core cable 70 into the cylinder part 31 from this state, the tip end portion of the sheath 71 is held by an inner periphery of the cylinder part 31, so that the electric cords 72 are inserted into the respective slits 33. At this time, since the tip end of the sheath 71 comes into contact with a stepped portion (not shown) provided in the inner periphery of the cylinder part 31, the amount of the sheath 71 pushed into the cylinder part 31 is limited. This maintains the tip end of the sheath 71 at substantially a constant position. Then, the operator rotates the terminal screw 11 in the fastening direction and screws it to a predetermined torque, so that the crimped terminal 73 of each of the electric cords 72 is interposed between the corresponding terminal plate 12 and the fastening plate 13. Note that, in this state, the flat portions 34 of the electric wire positioning member 30 are in contact with the protrusions 22*e* of the cover 22, thereby allowing the cylinder part 31 to be located at a correct position relative to the cover 22.

When the operation of connecting the electric cords 72 to the respective screw terminal blocks 10A, 10A and 10B is completed, the operator overlays the electric wire positioning member 30 and the body block 26 with the shell 23, and screws the mounting screw 25, inserted through the insertion holes 21*d* and 22*c*, into a screw hole (not shown) provided inside the shell 23. Thus, the body block 26 is fixed to the opening of the shell 23. Next, in the state where the supporting bodies 51 and 52 are coupled together so as to sandwich the boss section 23*e* of the shell 23 therebetween, the operator screws the mounting screws 53 into the nuts 54 through the insertion holes 51*c* and 52*c* of the supporting bodies 51 and 52 and the insertion hole 23*d* of the boss section 23*e*, whereby the supporting bodies 51 and 52 are coupled to the rear end of the shell 23. At this time, the sheath 71 of the multi-core cable 70 is interposed between the supporting bodies 51 and 52, thereby preventing the multi-core cable 70 from being affected by a tensile stress applied thereto. Note that the screw head of the mounting screw 53 and the nut 54 are accommodated within the recesses formed in the outer periphery of the supporting bodies 51 and 52 respectively, so that the screw head of the mounting screw 53 and the nut 54 are not protruded outward from the outer periphery of the supporting bodies 51 and 52. Finally, the elastic band 60 is engaged with the recessed grooves 51*a* and 52*a*, so that the assembly of the attachment plug 1 is completed.

The attachment plug 1 of the present embodiment includes the screw terminal blocks 10A and 10B described in the first embodiment; the plug body 20; the plug blades/pin 41 and 42; and the multi-core cable 70. The plug body 20 accommodates the screw terminal blocks 10A and 10B. The plug blades/pin 41 and 42 are electrically connected to the terminal plates 12 of the respective screw terminal blocks 10A and 10B; protrude outward from the plug body 20; and are plug-in connected to a plug receiver (not shown) such as a receptacle or an extension socket. The multi-core cable 70 is connected to the screw terminal blocks 10A and 10B, and extended outward from the plug body 20.

As described in the first embodiment, each of the screw terminal blocks 10A and 10B include: the terminal plate 12 provided with the insertion hole 12*a* through which the terminal screw 11 is inserted; and the fastening plate 13 provided with the screw hole 13*a* to which the terminal screw 11 inserted through the insertion hole 12*a* is screwed. Further, the rotation restricting part for restricting the rotation of the fastening plate 13 is provided in the terminal plate 12.

In this way, the terminal plate 12 and the fastening plate 13 are fixed by using the terminal screw 11. The rotation restricting part restricts the terminal plate 12 and the fastening plate 13 to rotate relatively in the state where the conductive part is connected in between the terminal plate 12 and the fastening plate 13. Accordingly, even if the torque of loosening the terminal screw 11 is applied to the electric cord 72 connected to the screw terminal block 10A or 10B, the fastening plate 13 can hardly rotate in the direction of loosening the terminal screw 11, thereby making it difficult to loosen the terminal screw 11.

Figure 11A:
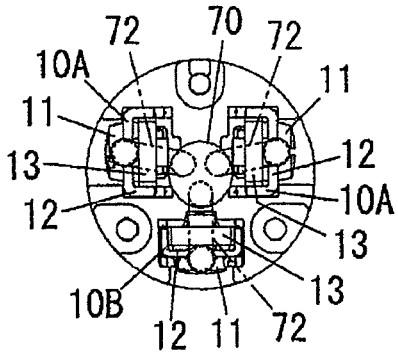
Figure 11B:
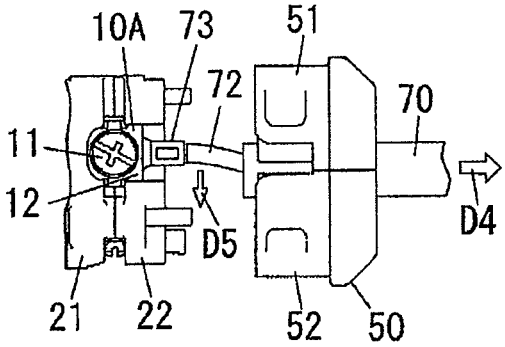
Figure 11C:
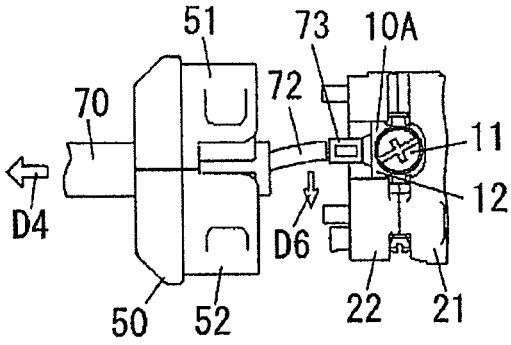
Figure 11D:
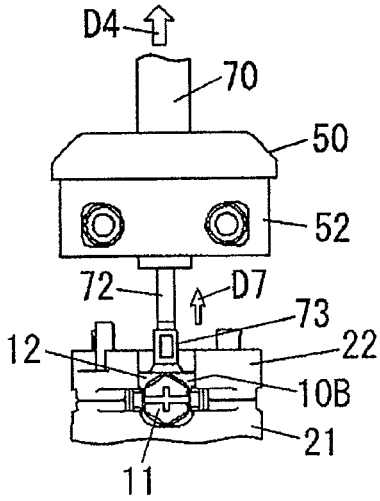

In the case where a tensile force is applied to the multi-core cable 70 due to, for example, a fall of the attachment plug 1, the state of the screw terminal blocks 10A and 10B will be described with reference to FIGS. 11A to 11D. As shown in FIG. 11A, the multi-core cable 70 is positioned at a center of the cylindrical plug body 20. On the other hand, the pole arrangement of plug blades/pin 41 and 42 is decided as follows: the W-pole screw terminal block 10A (the left-hand side in FIG. 11A) of the power blades (W-pole and L-pole) is arranged at a slightly upper-left portion relative to the multi-core cable 70 viewed from backward, the L-pole screw terminal block 10A (the right-hand side in FIG. 11A) is arranged at a slightly upper-right portion relative to the multi-core cable 70, and the ground screw terminal block 10B is arranged substantially just below the multi-core cable 70 viewed from backward. Herein, if the multi-core cable 70 is pulled backward (in the direction indicated by the arrow D4), the electric cord 72 in the W-pole screw terminal block 10A will be pulled as shown in FIG. 11B, so that the torque in the direction indicated by the arrow D5 is applied to the crimped terminal 73. Since the screw terminal block described in the first embodiment is employed as the W-pole screw terminal block 10A, the locking piece 12*b* of the terminal plate 12 and the protrusion 13*b* of the fastening plate 13 are brought into contact with each other, so that the relative rotation of the terminal plate 12 and the fastening plate 13 is restricted, thereby preventing the terminal screw 11 from loosening. Likewise, if the electric cord 72 in the L-pole screw terminal block 10A is pulled as shown in FIG. 11C, the torque in the direction indicated by the arrow D6 will be applied to the crimped terminal 73. This direction, however, serves as a direction of fastening the terminal screw 11, thereby causing no problem even if the fastening plate 13 rotates in conjunction with the crimped terminal 73. Further, if the electric cord 72 in the ground pole screw terminal block 10B is pulled as shown in FIG. 11D, the crimped terminal 73 is also pulled backward (in the direction indicated by the arrow D7), so that no force in a direction of rotating the crimped terminal 73 is caused. Thus, the terminal screw 11 is not loosened.

As just described, since the attachment plug 1 includes the screw terminal blocks 10A and 10B described in the first embodiment, the terminal screw 11 of the screw terminal blocks 10A and 10B is hardly loosened even if the attachment plug 1 is used under such an environment that an impact shock due to a fall or the like is likely to be applied to the attachment plug 1. This improves its reliability in electrical connection.

Note that, in the above embodiment, the plug pin is provided integrally with the terminal plate of the screw terminal blocks 10A and 10B, but not limited thereto. The plug pin and the terminal plate may be provided separately and electrically connected to each other via another conductive member. Further, the plug pin is not necessary to be provided integrally with the terminal plate. The above screw terminal blocks 10A and 10B may be used as an independent terminal block for wiring accessories such as a receptacle and a switch.

While the invention has been shown and described with respect to the embodiments, it will be understood by those skilled in the art that various changes and modification may be made without departing from the scope of the invention as defined in the following claims.

What is claimed is:

1. A screw terminal block, comprising:

a terminal screw;

a terminal plate provided with an insertion hole through which the terminal screw is inserted;

a fastening plate provided with a screw hole to which the terminal screw inserted through the insertion hole is screwed; and a rotation restricting part for restricting the rotation of the fastening plate, wherein the rotation restricting part includes:

a protrusion provided on a side surface of the fastening plate; and two locking pieces protruding toward the fastening plate and provided on a side surface of the terminal plate such that the protrusion is disposed between the locking pieces.

2. The screw terminal block as set forth in claim 1, wherein a plug pin to be plug-in connected to a plug receiver is provided integrally with the terminal plate.

3. The screw terminal block as set forth in claim 1, wherein dimensions of the rotation restricting part and the fastening plate are designed such that the protrusion of the fastening plate is not protruded outward beyond the locking pieces of the terminal plate.

4. An attachment plug, comprising:

the screw terminal block as set forth in claim 1;

a plug body accommodating the screw terminal block;

a plug pin electrically connected to the terminal plate, the plug pin protruding outward from the plug body to be plug-in connected to a plug receiver; and an electric cord connected to the screw terminal block, the electric cord extending outward from the plug body.

5. The attachment plug as set forth in claim 4, wherein the plug pin is provided integrally with the terminal plate.

6. The attachment plug as set forth in claim 4, wherein the dimensions of the rotation restricting part and the fastening plate are designed such that the protrusion of the fastening plate is not protruded outward beyond the locking pieces of the terminal plate.

7. The attachment plug as set forth in claim 6, wherein the plug pin is provided integrally with the terminal plate.

8. The screw terminal block as set forth in claim 3, wherein a plug pin to be plug-in connected to a plug receiver is provided integrally with the terminal plate.

* * * * *